United States Patent [19]

Agabekov

[11] Patent Number: 5,038,257

[45] Date of Patent: Aug. 6, 1991

[54] ELECTRIC SUPPLY RAMP

[76] Inventor: Branka Agabekov, 73, route de Thonon, CH-1222 Vesenaz, Switzerland

[21] Appl. No.: 452,121

[22] Filed: Dec. 15, 1989

[30] Foreign Application Priority Data

Dec. 20, 1988 [CH] Switzerland ..... 4705/88

[51] Int. Cl.[5] ..... F21V 21/00

[52] U.S. Cl. ..... 362/219; 362/225; 362/249; 439/115; 174/72 B

[58] Field of Search ..... 362/219, 225, 217, 227, 362/249; 439/115, 239, 744, 746, 787, 796, 721; 174/72 B

[56] References Cited

U.S. PATENT DOCUMENTS

| | | | |
|---|---|---|---|
| 3,995,103 | 11/1976 | Gehrs et al. | 174/72 B |
| 4,158,221 | 6/1979 | Agabekov | 362/219 |
| 4,382,156 | 5/1983 | Jodoin | 174/72 B |
| 4,521,838 | 6/1985 | Agabekov | 362/219 |
| 4,569,568 | 2/1986 | Agabekov | 439/110 |
| 4,723,199 | 2/1988 | Freed et al. | 362/219 |
| 4,858,088 | 8/1989 | Agabekov | 362/219 |
| 4,874,320 | 10/1989 | Freed et al. | 439/239 |

FOREIGN PATENT DOCUMENTS

| | | | |
|---|---|---|---|
| 603981 | 4/1960 | Italy | 362/219 |

*Primary Examiner*—Ira S. Lazarus
*Assistant Examiner*—Richard R. Cole
*Attorney, Agent, or Firm*—Ostrolenk, Faber, Gerb & Soffen

[57] ABSTRACT

Disclosed is an electric ramp comprising an insulating support below which there are arranged two conductive strips that are superimposed and separated from each other by an insulating body. The conductive strips each have plates cut out in the direction of the strips and folded about 90°; the free end of the plates being adapted to position an electric contact of a current-consuming element. Each plate, further, has a U-shaped cut defining a tab connected to the plate and adapted to be deformed in such a manner that its free edge cooperates with an outer face of the insulating support to hold together the ramp.

18 Claims, 4 Drawing Sheets

ELECTRIC SUPPLY RAMP

BACKGROUND AND SUMMARY OF THE INVENTION

The present invention relates to an electric supply ramp for current-consuming devices such as illuminating systems.

A known electric feed ramp employs a succession of pairs of electric contacts intended to receive a current-consuming element. Such electric feed ramp includes metallic conductive strips with protrusions forming the electric contacts and passing through slots provided in an insulating support.

Swiss Patent 599,501 describes an illuminating ramp having a support with wings that form an angle of 90° with each other Metal strips are mounted on the inner surfaces of the wings. Such metal strips comprise L-shaped clips fastened alternately in pairs at predetermined distances on one and the other of the metal strips in order to hold the lamps mounted along the axis of the profile.

From Swiss Patent 652,537 the possibility is known of replacing the L-shaped clips by tabs which are cut out in the direction of the strip and folded 90°, the end of the tab having a hole intended to position an electric contact of a current-consuming element. The metal strips are fastened on the wings by means of rivets.

The present invention is directed to simplifying the mounting of the components of the known illuminating ramps and, in one form, comprises an illuminating ramp having a succession of pairs of electric contacts including at least two conductive strips having at predetermined distances plates arranged at 90°. The free ends of such plates are arranged in such a manner as to position, at least indirectly, an electric contact of a current-consuming element.

The invention is characterized by the fact that the conductive strips are superimposed and are each covered by an insulating body, and by the fact that the conductive strips and the insulating bodies have openings for the passage of the plates of strips arranged below.

In the first embodiment, an intermediate insulating body in the form of a flat strip is arranged between two superimposed strips, while the upper insulating body is formed of a support that has a longitudinal cutout limited by protection wings and intended to receive the conductive strips and the intermediate insulating body (or bodies). This support, furthermore, has transverse slots for the passage of the contact plates.

In a preferred variant, the insulating support comprises, on its outer face, cylindrical recesses adapted to create reflection surfaces.

In another preferred embodiment, the insulating body consists of a covering applied to each metallic strip, with the exception of the contact plates.

One possible embodiment involves each plate having a U-shaped cut defining a tab connected to said plate and adapted to be deformed in such a manner that its free edge cooperates with the face of the insulating support.

BRIEF DESCRIPTION OF THE PREFERRED EMBODIMENT

Other objects, features and advantages of the present invention will be understood from the following detailed description of embodiments thereof, with reference to the drawings.

DESCRIPTION OF THE PREFERRED EMBODIMENTS

Figure 1:
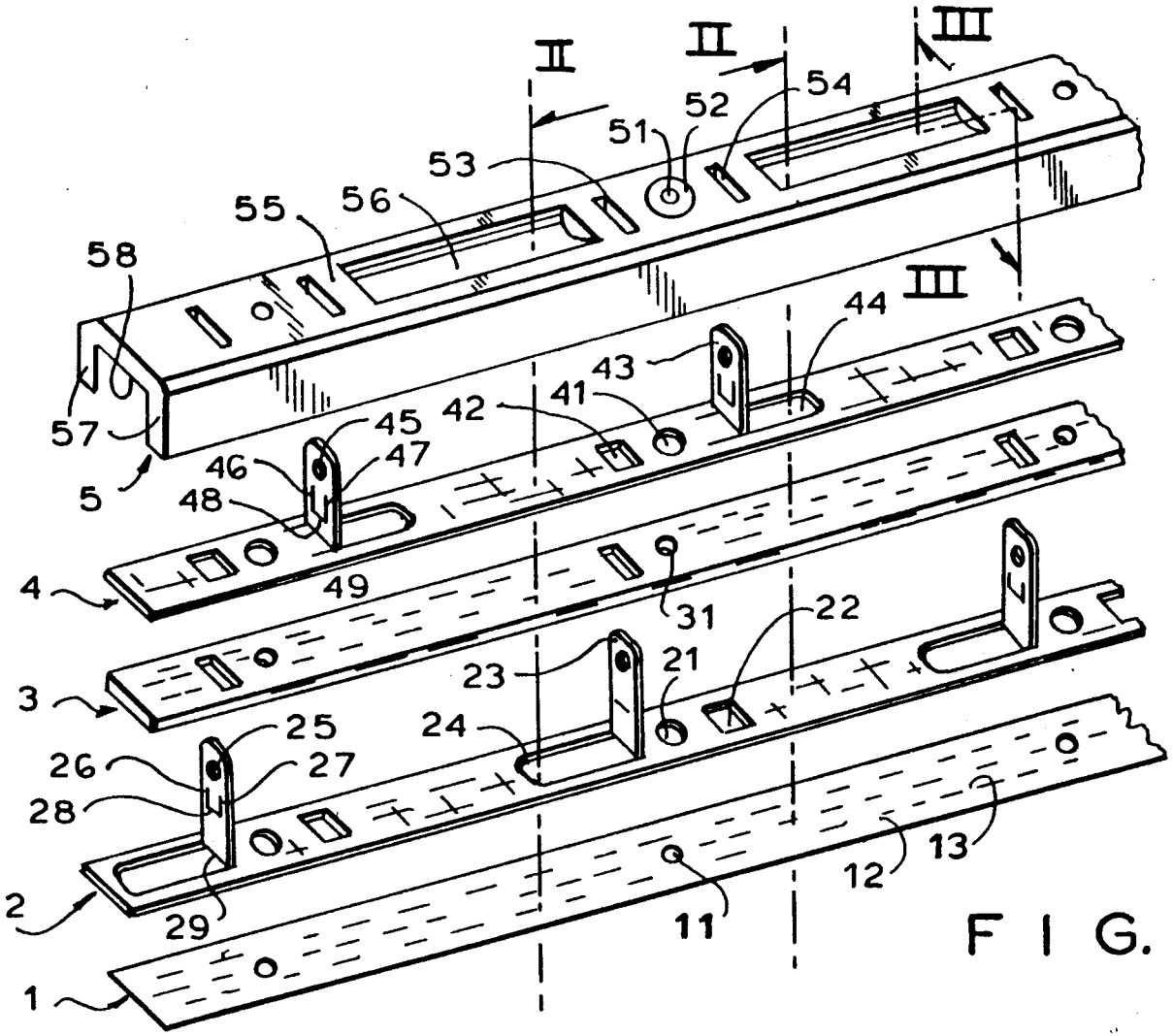
FIG. 1 is an exploded view in perspective of the principal components of a ramp of a first embodiment of the invention.

Referring to FIG. 1, the ramp is formed by superimposing a protective insulating strip 1, a first conductive strip 2, an insulating brace 3, a second conductive strip 4 and an insulating support 5.

The insulating strip 1 is provided over its length with a succession of openings 11 that permit the passage of ramp-fastening elements. The upper face 12 of the insulating strip 1 has an adhesive layer which permits its attachment to the conductive strip 2. In an alternative embodiment, the lower face 13 can comprise an adhesive strip which permits convenient mounting of the entire ramp assembly.

The first conductive strip 2 is intended to be connected by conventional means to one of the terminals of an electric supply, not shown in the drawing. The conductive strip 2 comprises, at uniform intervals, a series of openings 21 permitting the transverse passage of fastening members, as well as a series of slots 22, the reason for the presence of which will be indicated below. The connecting members 23 are integral with the conductive strip 2 and are formed by plates that are bent about 90° with respect to the strip 2, which leaves a corresponding recess 24 present in the latter. Each plate 23 is provided at its end with a round opening 25 and a U-shaped cut 26 defining a tab 27 connected at its upper part to the plate 23 and the free edge 28 of which is parallel to the fold line 29. The distance between the edge 28 and the fold line 29 corresponds to the cumulative thickness of the insulating brace 3, the second conductive strip 4 and the upper face region of the insulating support 5. The connecting members 23 are spaced uniformly over the length of the conductive strip 2.

The insulating brace 3 has a series of openings 31 for the passage of possible fastening members of the ramp. It also comprises at uniform intervals, transverse slots 32 dimensioned so as to permit the plates 23 to pass through.

The second conductive strip 4 is connected to the second terminal of the above-mentioned electric supply and has a series of openings 41, as well as transverse cutouts 42 the dimensions of which are greater than the cross-section of the plates 23 in order to prevent any contact between the lower and upper conductive strips 2 and 4.

The second conductive strip 4 also has, at uniform intervals, connecting members formed of plates 43 that are integral with the conductive strip, creating corresponding recesses 44 in the strip. Each plate 43 is provided at its free end with a round opening 45 and a U-shaped cut 46 defining a tab 47 that is connected at its upper part to the plate 43, and the free edge 48 of which is parallel to the fold line 49. The distance between the edge 48 and the fold line 49 corresponds to the thickness of the upper face region of the insulating support 5, so that the openings 25 and 45 are arranged at the same height, on a common axis.

The insulating support 5 has a series of passages 51 for the connecting members, some of these passages having a conical cutout 52 for the insertion of fastening screws of the ramp into a support, not shown in the drawing; as well as having a series of transverse slots 53 and 54 for the passage of the plates 23 and 43 respectively. The upper face 55, furthermore, has cylindrical recesses 56, the purpose of which will be indicated further below.

The upper face 55 is terminated on each side by a wing 57 which is intended to create, in the lower part of the support 5, a cutout 58 intended to receive the elements 1 to 4 mentioned above, as can be noted from FIG. 3.

Figure 3:
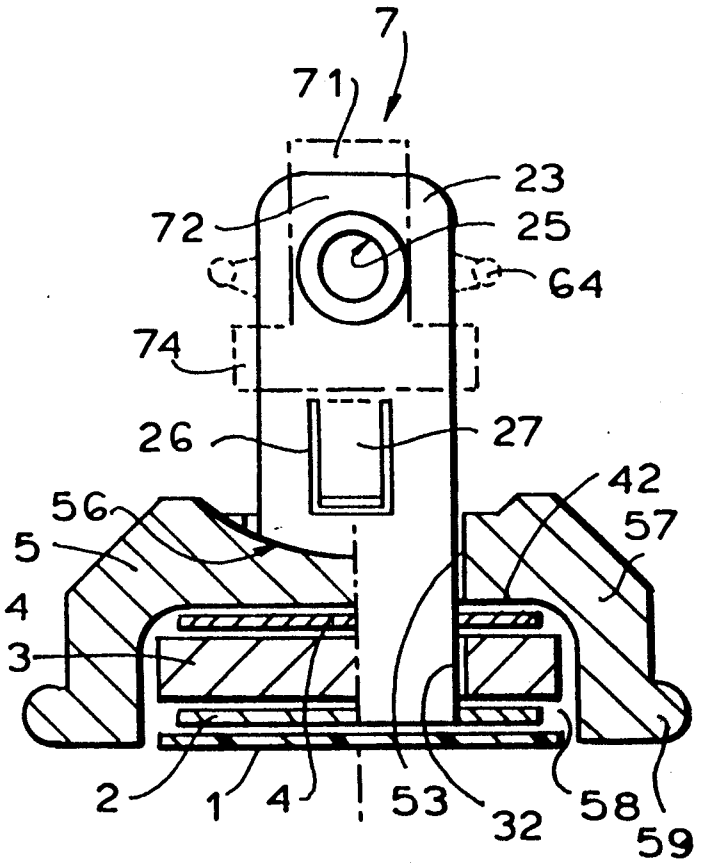
FIG. 3 is a cross-section through the assembled unit, at the level of the arrow III of FIG. 1 on the left side of the drawing, and at the level of the arrow III' of FIG. 1 on the right side.
Figure 2:
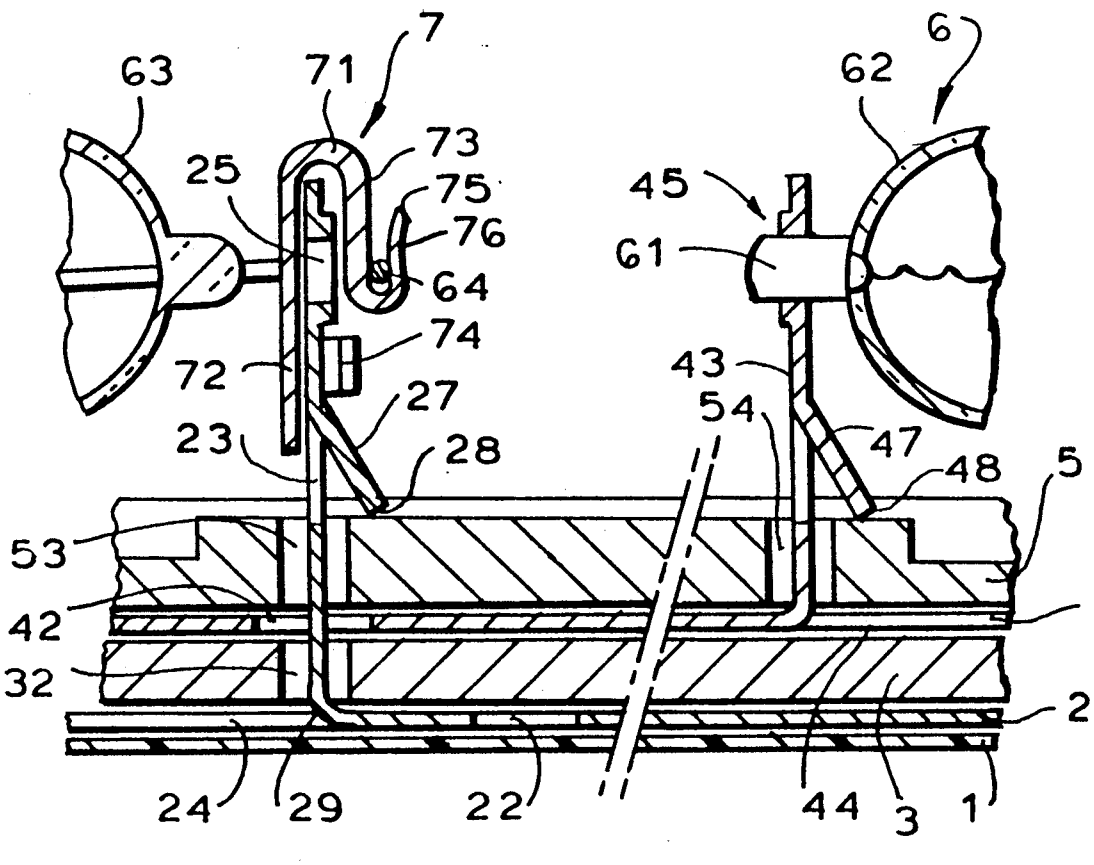
FIG. 2 is a longitudinal section through the assembled unit, taken between the arrows II—II of FIG. 1.

In the left-hand part of FIG. 3, the cylindrical recess 56 has been shown in section and it can be noted that its radius is centered at the middle of the round opening 25 so as to create a reflection surface for the source of light 6 (FIG. 2). For this purpose, the surface of the cylindrical recess may have an unstructured, shiny surface. A reflective covering can also be provided.

It will also be noted from FIG. 3 that the wings 57 have an outer longitudinal rim 59 which permits the fastening of the ramp in clips or in a suitable profiled member, not shown in the drawing.

The light ramp of FIG. 1 is shown in mounted condition in FIGS. 2 and 3. The mounting of the elements indicated above is effected by superimposing the conductor strips 2 and 4 separated by the insulating brace 3, and the introduction of this assembly into the central cutout 58 of the insulating support 5. The mounting is effected by folding the tabs 27, 47 over the upper face 55. The protective insulating strip 1 is fastened along the entire conductive strip 2, for instance by gluing.

As a variant, the elements of the ramp could be assembled by rivets which pass through the openings 11, 21, 31, 41, and 51, while seeing to it that the dimensions of the openings 21 and 41 are sufficient to avoid any electrical contact.

It will be noted from FIG. 2 that the round openings 25 and 45 are cut out, leaving a rim intended to improve the contact with the base 61 of the lamp 62. In the left-hand part of FIG. 2 there is shown in part a halogen festoon lamp 63 having a contact loop 64 at each end. In order to permit the mounting thereof, use may advantageously be made of a contact bushing 7 intended to be placed over the plates 23 or 43.

The bushing 7 is formed, for instance, by a fold comprising a central part 71 of U-shape having arms 72 and 73 arranged on opposite sides of the plate 23 or 43. The arm 72 has two side wings 74 that are curved so as to hold the bushing on the contact plate. The end 75 of the arm 73 is furthermore curved upward by about 180° in order to provide a housing 76 for the contact loop 64 of the lamp 63. The bushing 7 is shown in dashed line in FIG. 3 in order not to impair understanding of the drawing.

In practice, the distance between a pair of plates 23 and 43, which are intended to receive a lighting element, is of a size corresponding to the standard lengths of commercial festoon lamps, for instance 40 mm, and these lamps can be arranged every 55 mm. In the case of halogen lamps, the contact loops are about 43 mm apart, which makes it possible to add the riders 7 which have been described previously.

As a variant, each plate can bear two current-consuming elements, one on the right and the other on the left, and in this case the distance between the successive plates corresponds to the length of these elements.

The profiled members of the insulating support 5 and of the insulating brace 3 are preferably made of plastic. The conductive strips 2 and 4 are of metal, preferably brass. It will be noted that identical strips can be machined and that the difference between the upper strip 4 and the lower strip 2 is due solely to the location of the fold line 29 or 49. In this particular case, the strips are arranged in opposite direction, that is to say the plates 43 are lifted towards the left while the plates 23 are lifted towards the right, as seen in FIG. 1. In order to be able to use the same conductive strips, the lower strip has slots 22 which have no intrinsic use. As a variant, the strips 2 and 4 may be of different widths.

Figure 4:
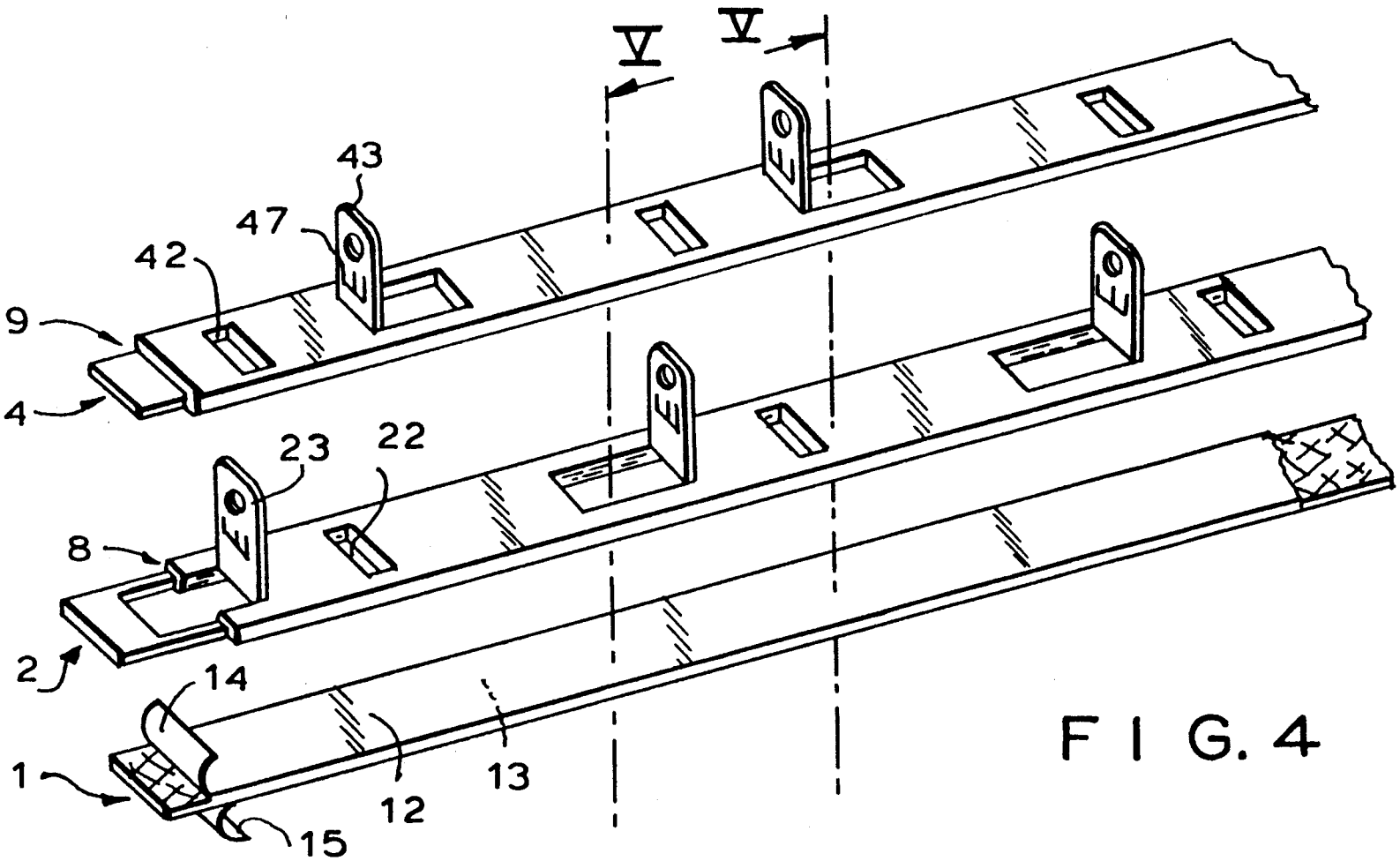
FIG. 4 is an exploded perspective view of the main components of a ramp of a second embodiment.

In the further embodiment shown in FIGS. 4 to 6, there is again present the insulating protection strip 1, the first conductive strip 2 and the second conductive strip 4, while the insulating bodies are formed of coverings 8 and 9 applied onto the strip 2 and the strip 4, respectively.

The upper face 12 of the strip 1 has an adhesive layer that is protected by a detachable strip 14 that will be withdrawn upon the mounting of the assembly. The lower face 13 also has an adhesive layer that is protected by a strip 15 that will be removed in order to permit the attachment of the assembly at the desired location.

As previously described, the conductive strips 2 and 4 are identical and arranged in opposite directions, the slots 22 being located to the right of the plates 23 while the slots 42 are arranged to the left of the plates 43. The only difference between the strips is the position of the fold line 29 or 49, visible in FIG. 5.

Figure 5:
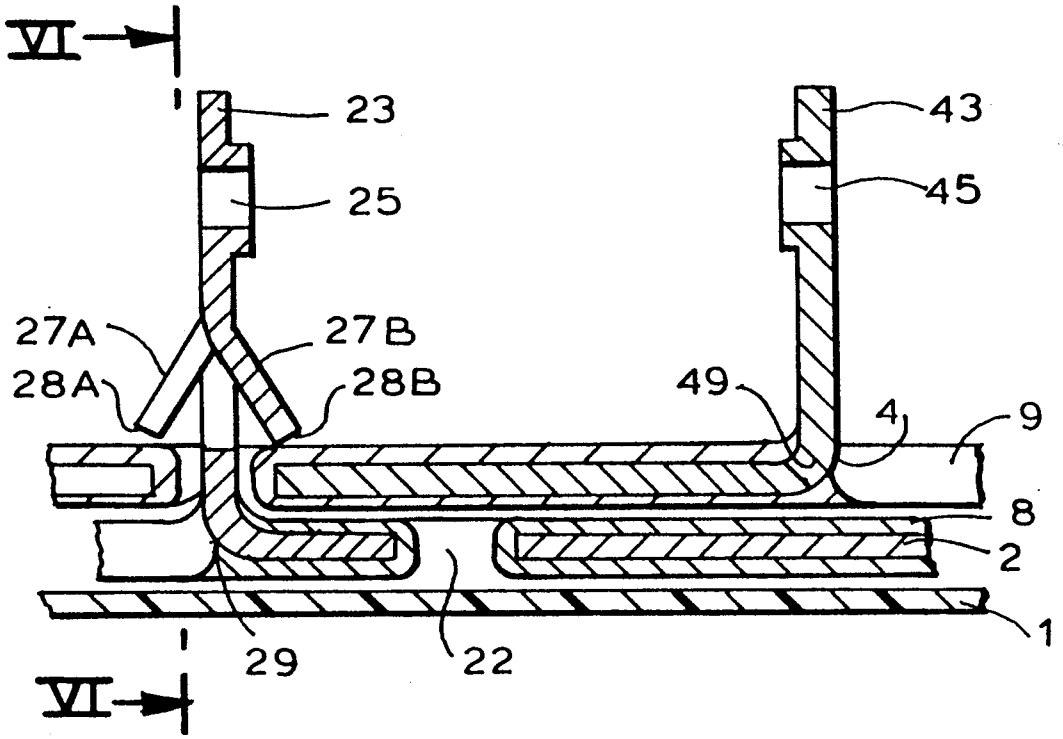
FIG. 5 is a longitudinal section through the assembled unit of FIG. 4, taken between the arrows V—V in FIG. 4.

The insulating coverings 8 and 9 are preferably formed by application of an enamel in a furnace. It is obvious that the insulating covering is not to extend over the edges of the openings 25 and 45 (FIG. 5) which are intended to receive the contacts of the current-consuming element. As shown in FIG. 5, the insulating body 8 or 9 may be stopped in the vicinity of the fold lines 29 and 49.

By using a white paint for the upper insulating body 9, one obtains, at the same time, a reflecting surface for the lamp inserted between the plates 23 and 43.

Figure 6:
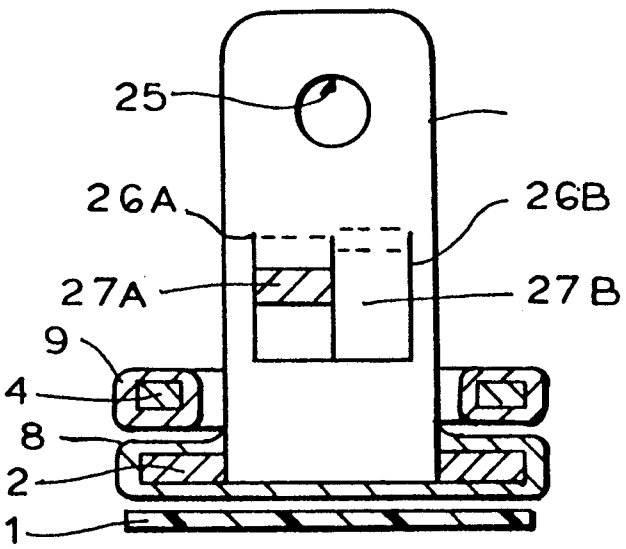
FIG. 6 is a cross section along the line VI—VI of FIG. 5.

It will be noted in FIGS. 5 and 6 that the plate 23, which traverses the upper conductive strip 4 and its covering 9 through the slot 42, has two Ushaped cuts 26A and 26B defining two tabs 27A and 27B intended to be folded in opposite directions, so that their free edges 28A and 28B come to rest on opposite sides of the slot 42, so as to assure the mounting of the assembly.

As a variant, the two tabs can be folded to the same side of the plate. Furthermore, the tabs can be developed also on the edges of the plate rather than at its center.

The invention is not limited to an illuminating lamp employing bulbs and one can, as a variant, use the present principle of fitting together two conductive strips in a plastic-profiled body by adapting the distance apart and the shapes of the connecting elements to other sources of light or to other current-consuming elements.

Without going beyond the scope of the present invention, one could also insert between the conductive plates conductive adaptors or supports for fork-contact illuminating lamps, for instance halogen lamps. The supports can, as a variant, permit the orienting of luminous elements such as spotlights. Furthermore, the number of conductive strips is not limited to two, a larger number making it possible to obtain a ramp with several intensities of illumination.

Ordinarily-skilled artisans will, moreover, recognize that in FIG. 1, for example, the directions among different parts (e.g., strip 4 "overlying" insulating body 5) apply only to the ramp assembly, which could be used in any desired orientation.

Although the present invention has been described in connection with preferred embodiments thereof, many variations and modifications will now become apparent to those skilled in the art. It is preferred, therefore, that the present invention be limited not by the specific disclosure herein, but only by the appended claims.

What is claimed is:

1. An illuminating ramp having a succession of pairs of electric contacts, the ramp comprising:

first and second conductive strips, each strip having respective plates which are cut out from the strip along the length direction of the strips and are folded outwardly of the plane of the plate in a first direction; each plate having a free end that is arranged for positioning thereat, at least indirectly, an electric contact of a current-consuming element;

the second conductive strip being superimposed above the first conductive strip;

a respective first and second insulating member covering the first and second conductive strips and the first insulating member being between the first and second conductive strips; an upper face of the ramp above the second insulating member; and the conductive strips and the insulating members having openings therethrough for the passage through the openings of the plates of at least one of the conductive strips;

each plate having at least one cutout in it defining a tab, the tab having a connected side which is connected to the plate and the tab having a free edge opposite the tab connected side, the tab being deformable with respect to the plate such that the tab free edge is out of the plane of the plate and is located for cooperating with the upper face of the ramp to hold together the ramp.

2. An illuminating ramp according to claim 1, wherein each plate is folded out from its conductive strip at a fold line and each tab free edge is parallel to the fold line of its associated plate with respect to its associated strip.

3. An illuminating ramp according to claim 2, wherein the first and second conductive strips are substantially identical except the respective plates of the first strip are longer than the respective plates of the second strip.

4. An illuminating ramp according to claim 3 wherein:

the distance between the free edge of the plate on the first conductive strip and its associated fold line corresponds to the cumulative thickness of the first insulating member on the first conductive strip, the second conductive strip, and an outer face region of the second insulating member; and the distance between the free edge of the plate on the second conductive strip and its associated fold line corresponds to the thickness of the outer face region of the second insulating member.

5. An illuminating ramp according to claim 3, wherein the strips are arranged so that the plates are folded in the first direction up above the top surfaces of the strips, and the plates of the first strip are folded up from the first strip in opposite directions from the plates of the second strip.

6. An illuminating ramp according to claim 3, further comprising second openings provided at the free ends of the plates and intended for receiving the current-consuming elements, the fold lines of the plates being placed so that the plates have a length such that the second openings are on a common axis.

7. An illuminating ramp according to claim 1, wherein the second insulating member of the second strip has a longitudinal cutout intended to receive the conductive strips and the first insulating member which is situated between the strips, the longitudinal cutout having an interior surface to receive the conductive strips and the plates protruding from the upper surface of the second insulating member.

8. An illuminating ramp according to claim 7, wherein the second insulating member is formed with longitudinal insertion rims.

9. An illuminating ramp according to claim 7, wherein the second insulating member is provided on an outer face with cylindrical recesses serving as reflection surfaces.

10. An illuminating ramp according to claim 9, wherein the reflection surfaces are provided with respective reflective coverings.

11. An illuminating ramp according to claim 7, wherein the first conductive strip, the first insulating member on the first conductive strip, the second conductive strip and the second insulating member having superimposed openings therethrough adapted to be traversed by fastening elements for the ramp, the openings in the conductive strips being dimensioned to avoid any electrical contact between the strips.

12. An illuminating ramp according to claim 7, wherein the first and second and the insulating members are of plastic.

13. An illuminating ramp according to claim 1, wherein the insulating members are formed of a respective coating applied on each conductive strip, with the exception of the contact plates.

14. An illuminating ramp according to claim 13, wherein the coating on each strip includes an adhesive surface and a protective removable cover sheet over each adhesive surface.

15. An illuminating ramp according to claim 1, further comprising an insulating protection strip provided below the first conductive strip.

16. An illuminating ramp according to claim 15, wherein at least one face of the insulating protection strip is adhesive.

17. An illuminating ramp according to claim 1, wherein the current-consuming elements are festoon lamps.

18. An illuminating ramp according to claim 17, wherein the plates are adapted to receive an intermediate bushing.

* * * * *